US011358382B2

(12) United States Patent
Choi et al.

(10) Patent No.: US 11,358,382 B2
(45) Date of Patent: Jun. 14, 2022

(54) PAD PRINTING DEVICE

(71) Applicant: Samsung Display Co., LTD., Yongin-si (KR)

(72) Inventors: Beomgyu Choi, Seoul (KR); ByoungYul Shim, Hwaseong-si (KR); Junga Lee, Hwaseong-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/905,321

(22) Filed: Jun. 18, 2020

(65) Prior Publication Data

US 2021/0023835 A1 Jan. 28, 2021

(30) Foreign Application Priority Data

Jul. 22, 2019 (KR) ..... 10-2019-0088062

(51) Int. Cl.
*B41F 17/00* (2006.01)

(52) U.S. Cl.
CPC ..... *B41F 17/001* (2013.01)

(58) Field of Classification Search
CPC ..... B41F 17/001
USPC ..... 101/287
See application file for complete search history.

(56) References Cited

U.S. PATENT DOCUMENTS 6,176,185 B1 * 1/2001 Charlier ..... A44C 21/00 101/493
7,870,823 B1 * 1/2011 Cameron ..... B41F 17/006 101/41
8,820,230 B2 * 9/2014 Inoue ..... B41F 17/30 101/41
10,737,414 B1 * 8/2020 Stevenson ..... B41M 5/0358
2002/0185019 A1 * 12/2002 Tollhupp ..... B41F 15/20 101/41
2008/0105145 A1 * 5/2008 Schaafsma ..... B41F 17/001 101/41
2010/0040851 A1 * 2/2010 Schroeder ..... B41F 17/001 428/217

FOREIGN PATENT DOCUMENTS

KR 10-0663398 1/2007
KR 10-2013-0026238 3/2013
KR 10-1848253 4/2018

* cited by examiner

*Primary Examiner* — Anthony H Nguyen
(74) *Attorney, Agent, or Firm* — Kile Park Reed & Houtteman PLLC

(57) ABSTRACT

A pad printing device for printing a window of a display device includes a pad to transfer ink to the window. The pad includes a printing portion to transfer the ink to the window by being pressed against the window and a body portion disposed on the printing portion and to apply a pressure to the printing portion. A hardness of the printing portion is less than a hardness of the body portion, and a sidewall of a portion of the pad where the printing portion contacts the body portion is substantially perpendicular to the window.

15 Claims, 4 Drawing Sheets

PAD PRINTING DEVICE

CROSS-REFERENCE TO RELATED APPLICATION(S)

This application claims priority to and benefits of Korean Patent Application No. 10-2019-0088062 under 35 USC § 119, filed in the Korean Intellectual Property Office on Jul. 22, 2019, the entire contents of which are incorporated herein by reference.

BACKGROUND

1. Technical Field

Embodiments relate to a pad printing device for printing a pattern on a window for a display device.

2. Description of the Related Art

A display device may include a window for protecting a display panel, a touch panel, or the like which are included in the display device for providing an image which the display panel displays. A pattern may be formed on the window such that a conductive line disposed in a non-display area of the display device may not be observed by a user.

Various printing methods may be used to form a pattern on a surface of an object. For example, a pad printing method using a pad printing device may be used to form a pattern on a surface of an object that has a three-dimensional shape.

Recently, a window for a display device has been developed which includes a curved area bent in a desired or predetermined shape. When a pattern is printed on the window including the curved area by a pad printing method, if a pad of the pad printing device is not deformed to correctly or fully correspond to the curved area of the window, the pattern may not be printed on at least a portion of the curved area of the window.

In a printing device according to the related art, a pad may have the same hardness through an entire area thereof, and a sidewall of the pad may be inclined with respect to a plane area of the window. In this case, when the pad is pressed against the window, the pad may not be deformed to desirably fill a space surrounded by the plane area and the curved area of the window. As a result, a pattern may not be printed at a desired area of the window.

It is to be understood that this background of the technology section is, in part, intended to provide useful background for understanding the technology. However, this background of the technology section may also include ideas, concepts, or recognitions that were not part of what was known or appreciated by those skilled in the pertinent art prior to a corresponding effective filing date of the subject matter disclosed herein.

SUMMARY

Embodiments provide a pad printing device including a pad for printing a pattern on an entirety of a curved area of a window for a display device.

In a pad printing device for printing a window of a display device according to embodiments, the pad to transfer ink to the window, includes a printing portion to transfer the ink to the window by being pressed against the window and a body portion disposed on the printing portion to apply a pressure to the printing portion. A hardness of the printing portion may be less than a hardness of the body portion, and a sidewall of a portion of the pad where the printing portion contacts the body portion may be substantially perpendicular to the window.

In an embodiment, the printing portion and the body portion may include silicon, and an amount of an oil contained in the printing portion may be greater than an amount of an oil contained in the body portion.

In an embodiment, the printing portion may have a shore A hardness from about 7 to about 15.

In an embodiment, the body portion may have a shore A hardness from about 16 to about 23.

In an embodiment, a sidewall of the printing portion may be substantially perpendicular to the window.

In an embodiment, a lower surface of the printing portion may include an inclined area inclined with respect to the sidewall of the printing portion.

In an embodiment, the inclined area may be disposed on the lower surface of the printing portion, and the lower surface of the printing portion may sequentially contact from a center portion to a peripheral portion of the window when the pad is pressed against the window.

In an embodiment, the window may include a plane area and a curved area adjacent to an edge of the plane area, and an angle between a longitudinal cross-section of the plane area and a longitudinal cross-section of the curved area may be an obtuse angle.

In an embodiment, a thickness of the printing portion of the pad may be greater than a height of the curved area of the window.

In an embodiment the thickness of the printing portion of the pad may be the height from a plane at which a surface of the sidewall of the body portion meets a surface of the sidewall of the printing portion of the pad to an apex of the printing portion of the pad, and the thickness of the printing portion may include the lower surface of the printing portion.

In an embodiment, the angle between the longitudinal cross-section of the plane area and the longitudinal cross-section of the curved area may be in a range from about 120 degrees to about 180 degrees.

In an embodiment, when the pad is pressed against the window, the printing portion may be substantially pressed against the plane area and the curved area.

In an embodiment, the pad printing device may further include a pad supporter coupled to the pad to support the pad. The body portion may be disposed between the printing portion and the pad supporter.

In a pad printing device for printing a window of a display device according to embodiments, the pad printing device may include a pad to transfer ink to the window, and the pad may include a printing portion to transfer the ink to the window by being pressed against the window and a body portion disposed on the printing portion to apply a pressure to the printing portion. When the pad is pressed against the window, a deformation degree of the printing portion may be greater than a deformation degree of the body portion, and a sidewall of a portion of the pad where the printing portion contacts the body portion may be substantially perpendicular to the window.

In an embodiment, a hardness of the printing portion may be less than a hardness of the body portion.

In an embodiment, the printing portion may have a shore A hardness from about 7 to about 15, and the body portion may have a shore A hardness from about 16 to about 23.

In an embodiment, the window may include a plane area and a curved area adjacent to an edge of the plane area, and an angle between a longitudinal cross-section of the plane area and a longitudinal cross-section of the curved area may be an obtuse angle.

In an embodiment, a thickness of the printing portion of the pad may be greater than a height of the curved area of the window.

In the pad printing device according to the embodiments, the hardness of the printing portion of the pad may be less than the hardness of the body portion of the pad, and the sidewall of at least a portion of the pad where the printing portion contacts the body portion may be substantially perpendicular to the window. Therefore, the printing portion of the pad may be deformed to contact an entirety of the curved area of the window, and the printing portion of the pad may print the pattern on an entirety of the curved area of the window.

BRIEF DESCRIPTION OF THE DRAWINGS

Illustrative, non-limiting embodiments will be more clearly understood from the following detailed description taken in conjunction with the accompanying drawings in which.

DETAILED DESCRIPTION OF THE EMBODIMENTS

Figure 1:
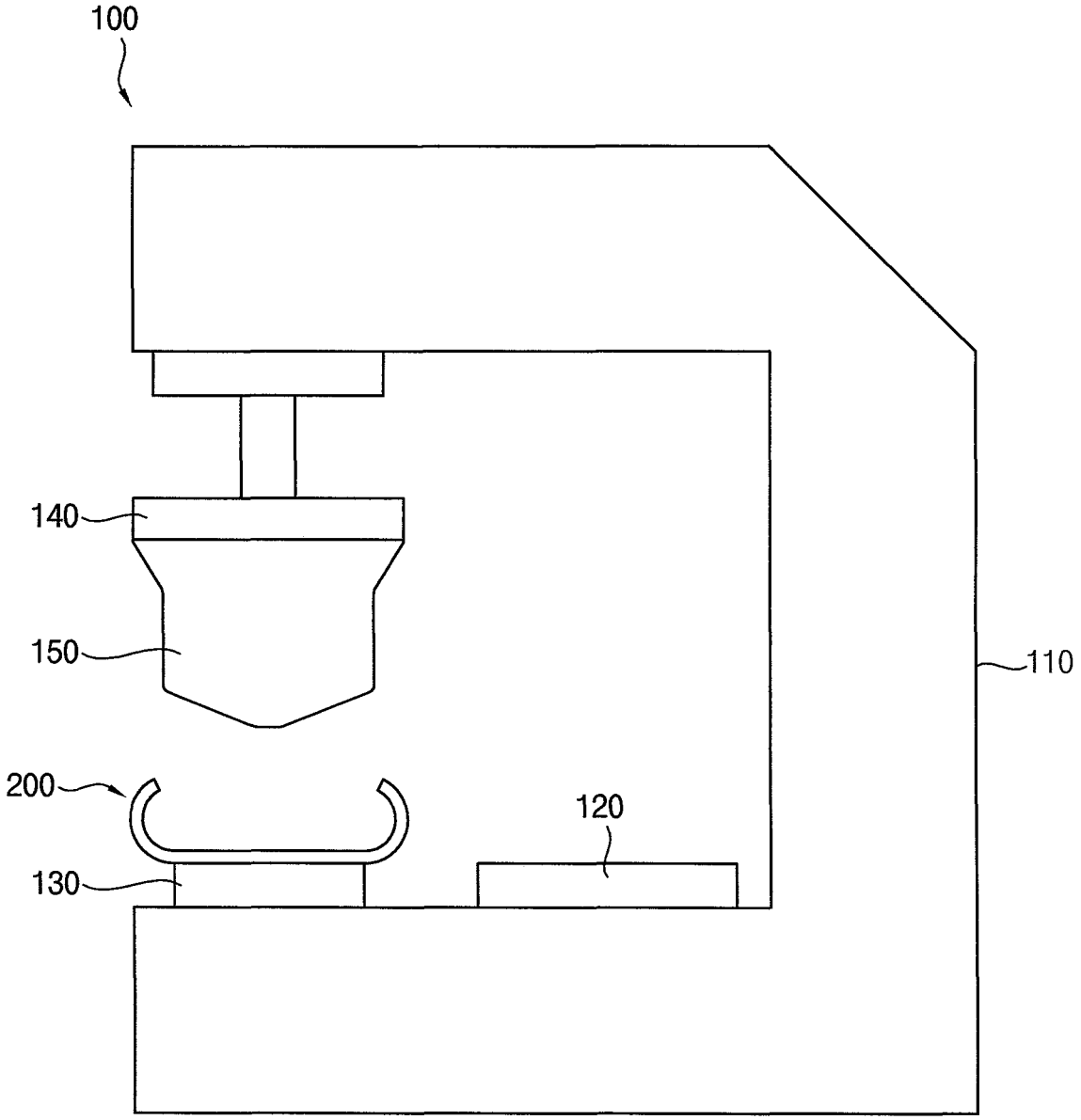
FIG. 1 is a diagram illustrating a pad printing device according to an embodiment.

Hereinafter, pad printing devices in accordance with embodiments will be explained in detail with reference to the accompanying drawings.

Although the disclosure may be modified in various manners and have additional embodiments, embodiments are illustrated in the accompanying drawings and will be mainly described in the specification. However, the scope of the disclosure is not limited to the embodiments in the accompanying drawings and the specification and should be construed as including all the changes, equivalents and substitutions included in the spirit and scope of the disclosure.

Some of the parts which are not associated with the description may not be provided in order to describe embodiments and like reference numerals refer to like elements throughout the specification.

In the drawings, sizes and thicknesses of elements may be enlarged for clarity and ease of description thereof. However, the disclosure is not limited to the illustrated sizes and thicknesses. In the drawings, the thicknesses of layers, films, panels, regions, and other elements may be exaggerated for clarity. In the drawings, for better understanding and ease of description, the thicknesses of some layers and areas may be exaggerated.

Further, in the specification, the phrase "in a plan view" means when an object portion is viewed from above, and the phrase "in a schematic cross-sectional view" means when a schematic cross-section taken by vertically cutting an object portion is viewed from the side.

When a layer, film, region, substrate, or area, is referred to as being "on" another layer, film, region, substrate, or area, it may be directly on the other film, region, substrate, or area, or intervening films, regions, substrates, or areas, may be present therebetween. Conversely, when a layer, film, region, substrate, or area, is referred to as being "directly on" another layer, film, region, substrate, or area, intervening layers, films, regions, substrates, or areas, may be absent therebetween. Further when a layer, film, region, substrate, or area, is referred to as being "below" another layer, film, region, substrate, or area, it may be directly below the other layer, film, region, substrate, or area, or intervening layers, films, regions, substrates, or areas, may be present therebetween. Conversely, when a layer, film, region, substrate, or area, is referred to as being "directly below" another layer, film, region, substrate, or area, intervening layers, films, regions, substrates, or areas, may be absent therebetween. Further, "over" or "on" may include positioning on or below an object and does not necessarily imply a direction based upon gravity.

The spatially relative terms "below", "beneath", "lower", "above", "upper", or the like, may be used herein for ease of description to describe the relations between one element or component and another element or component as illustrated in the drawings. It will be understood that the spatially relative terms are intended to encompass different orientations of the device in use or operation, in addition to the orientation depicted in the drawings. For example, in the case where a device illustrated in the drawing is turned over, the device positioned "below" or "beneath" another device may be placed "above" another device. Accordingly, the illustrative term "below" may include both the lower and upper positions. The device may also be oriented in other directions and thus the spatially relative terms may be interpreted differently depending on the orientations.

Throughout the specification, when an element is referred to as being "connected" to another element, the element may be "directly connected" to another element, or "electrically connected" to another element with one or more intervening elements interposed therebetween. It will be further understood that when the terms "comprises," "comprising," "includes" and/or "including" are used in this specification, they or it may specify the presence of stated features, integers, steps, operations, elements and/or components, but do not preclude the presence or addition of other features, integers, steps, operations, elements, components, and/or any combination thereof.

It will be understood that, although the terms "first," "second," "third," or the like may be used herein to describe various elements, these elements should not be limited by these terms. These terms are used to distinguish one element from another element or for the convenience of description and explanation thereof. For example, when "a first element" is discussed in the description, it may be termed "a second element" or "a third element," and "a second element" and "a third element" may be termed in a similar manner without departing from the teachings herein.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 5% of the stated value.

Unless otherwise defined, all terms used herein (including technical and scientific terms) have the same meaning as commonly understood by those skilled in the art to which this disclosure pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the specification.

FIG. 1 is a diagram illustrating a pad printing device according to an embodiment.

Referring to FIG. 1, a pad printing device 100 may include a case 110, a printing plate 120, a cradle 130, a pad supporter 140, and a pad 150. The case 110 may include elements for pad printing.

The printing plate 120 may be disposed in the case 110. A pattern may be formed on an upper surface of the printing plate 120 by engraving such as etching or other suitable methods. Ink for printing may be filled in the pattern. Although it is not illustrated in FIG. 1, an ink supplier for supplying the ink into the pattern of the upper surface of the printing plate 120 may be disposed at a side of the printing plate 120.

The cradle 130 may be disposed in the case 110. The cradle 130 may be spaced apart from the printing plate 120. A printing target that is an object of the pad printing may be located or disposed on the cradle 130. In an embodiment, the printing target may be a window 200 for a display device. The window 200 may be located or disposed on the cradle 130 such that a printing surface of the window 200 faces upward. A structure of the window 200 will be described with reference to FIG. 2 below.

The pad supporter 140 may be coupled to the pad 150 to support the pad 150. For example, the pad 150 may be fixed to the pad supporter 140. The pad supporter 140 may be connected to the case 110 to be raised and lowered. In an embodiment, the pad supporter 140 may be raised and lowered as well as moving above the printing plate 120 and the cradle 130.

The pad 150 may be coupled to the pad supporter 140. The pad 150 may move along the pad supporter 140 that may be raised and lowered and may move above the printing plate 120 and the cradle 130. The pad 150, together with the pad support 140, may move between the printing plate 120 and the cradle 130. A printing process may be performed by the movement of the pad 150. The pad 150 may move to above the printing plate 120, may be lowered, and may be in contact with the upper surface of the printing plate 120. Accordingly, the ink filled in the pattern of the printing plate 120 may be transferred to the pad 150. The pad 150 may move to above the cradle 130 after being raised, may be lowered, and may be pressed against the window 200. Accordingly, the ink of the pad 150 may be transferred to the window 200, and a pattern may be printed on the window 200. A structure of the pad 150 will be described with reference to FIG. 3 below.

Figure 2:
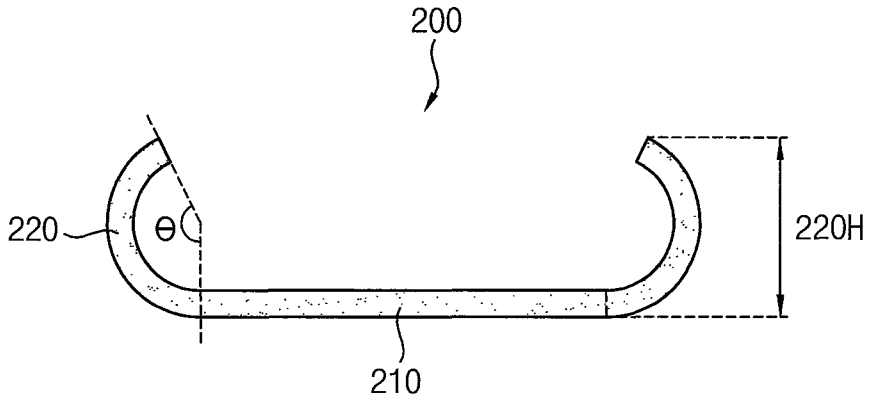
FIG. 2 is a diagram illustrating a window in FIG. 1.

FIG. 2 is a diagram illustrating the window 200 in FIG. 1.

Referring to FIGS. 1 and 2, the window 200 for the display device may be formed of transparent and flexible materials. For example, the window 200 may be formed of glass, plastic, or any other suitable material. Accordingly, the window 200 may transmit an image displayed from a display panel included in the display device. Further, the window 200 may be bent or curved in a desired or predetermined shape.

The window 200 may have a bent edge. Accordingly, the window 200 may include a plane area 210 and a curved area 220 adjacent to an edge of the plane area 210. In an embodiment, curved areas 220 may be formed adjacent to opposite edges of the plane area 210.

The curved area 220 may have a curvature. In an embodiment, a cross-sectional shape of the curved area 220 may be a part of a substantially circular arc or a part of a substantially elliptical arc. In an embodiment, the curved areas 220 adjacent to the opposite edges of the plane area 210 with the plane area 210 in between may have substantially the same or similar curvature.

An angle θ between a longitudinal cross-section of the plane area 210 and a longitudinal cross-section of the curved area 220 may be an obtuse angle. Here, the longitudinal cross-section of the plane area 210 may mean a cross-section between the plane area 210 and the curved area 220, and the longitudinal cross-section of the curved area 220 may mean a cross-section of an outermost edge of the curved area 220. As shown in FIG. 2, for example, the angle θ may be an obtuse angle between a virtual line of the longitudinal cross-section of the plane area 210, which is substantially perpendicular with respect to a surface of the plane area 210, and a virtual line of the longitudinal cross-section of the curved area 220, which is substantially perpendicular with respect to a surface of the curved area 220. In an embodiment, the angle θ between the longitudinal cross-section of the plane area 210 and the longitudinal cross-section of the curved area 220 may be in a range from about 120 degrees to about 180 degrees.

In an embodiment, when a radius of curvature of the curved area 220, which may have a cross-sectional shape corresponding to a part of a substantially circular arc, is about 3 mm and the angle θ between the longitudinal cross-section of the plane area 210 and the longitudinal cross-section of the curved area 220 is in a range from about 120 degrees to about 180 degrees, a height 220H of the curved area 220 may be in a range from about 4.5 mm to about 6.0 mm. However, the disclosure is not limited thereto, and the height 220H of the curved area 220 may be changed based on the radius of curvature of the curved area 220 and the angle θ between the longitudinal cross-section of the plane area 210 and the longitudinal cross-section of the curved area 220.

Figure 3:
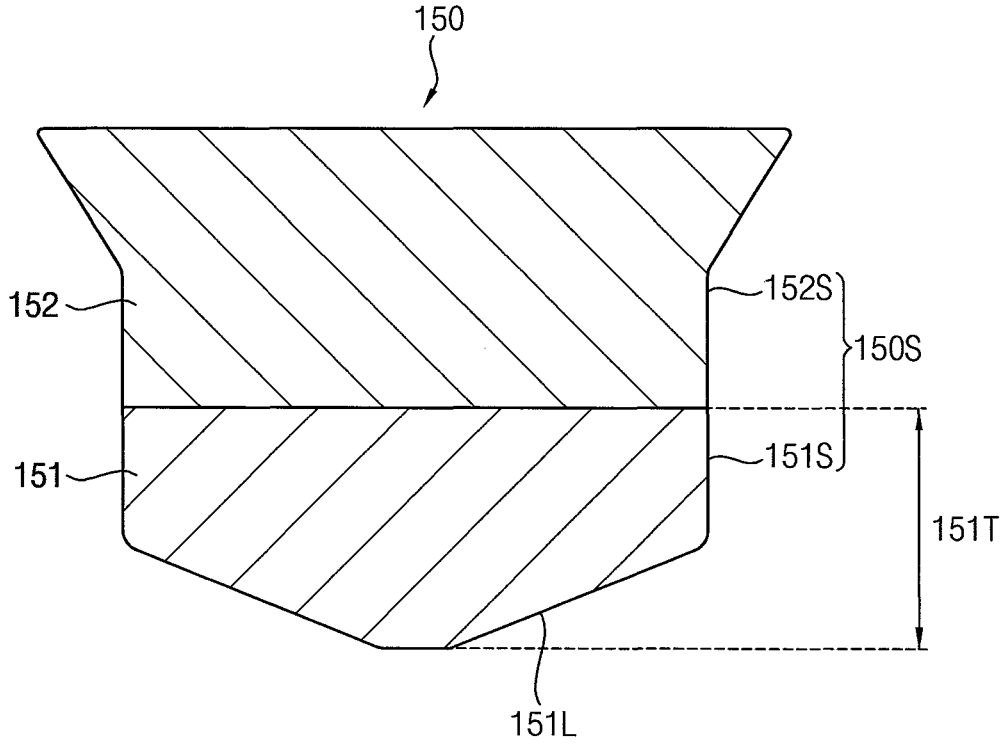
FIGS. 3 and 4 are diagrams illustrating a pad in FIG. 1.
Figure 4:
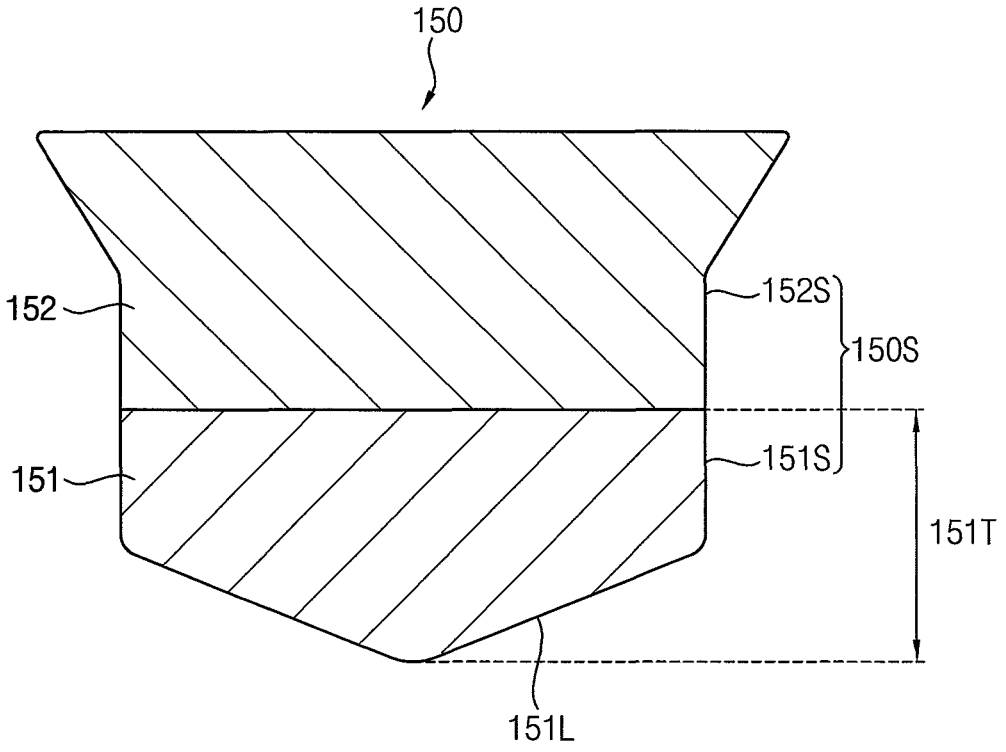

FIGS. 3 and 4 are diagrams illustrating the pad 150 in FIG. 1. FIG. 3 illustrates an example of the pad 150 in FIG. 1, and FIG. 4 illustrates another example of the pad 150 in FIG. 1.

Referring to FIGS. 1, 2, 3, and 4, the pad 150 may include a printing portion 151 and a body portion 152.

Ink may be transferred from the printing plate 120 having a pattern to the printing portion 151, and the printing portion 151 may transfer the ink to the window 200 so that the pattern may be printed on the window 200. The printing portion 151 may be pressed against the window 200 during a printing process so that the printing portion 151 may be deformed.

The body portion 152 may be disposed on the printing portion 151. The body portion 152 may be disposed between the printing portion 151 and the pad supporter 140. When the pad supporter 140 is lowered after moving to above the cradle 130, the pad 150 may be pressed against the window 200 so that the body portion 152 may apply a pressure to the printing portion 151. The printing portion 151 may be deformed based on the pressure applied to the printing portion 151 from the body portion 152, and the pattern may be printed on the window 200.

A hardness of the printing portion 151 may be less than a hardness of the body portion 152. Deformation degree of an object is a function of an object's hardness. For example, the less hard, or the softer an object, the greater the degree of deformation of the object with respect to an externally applied pressure. Here, the deformation degree of the object may mean a degree of deformation of the object by the pressure. Accordingly, when the pad 150 is pressed against the window 200 by descent of the pad supporter 140, a deformation degree of the printing portion 151 may be greater than a deformation degree of the body portion 152.

In an embodiment, the printing portion 151 may have a shore A hardness from about 7 to about 15. Here, the shore hardness means a hardness of an object measured by a shore hardness durometer. The shore hardness durometer measures the hardness of the object as a height at which an indentor collides with the object to bounce after dropping the indentor from a predetermined height. The shore A hardness means a shore hardness measured by a shore A type indentor. If the shore A hardness of the printing portion 151 is less than about 7, a degree of deformation of the printing portion 151 may increase more than necessary thereby decreasing an accuracy of the printing. If the shore A hardness of the printing portion 151 is greater than about 15, the printing portion 151 may not be sufficiently deformed to print a substantially entire surface of the window 200.

In an embodiment, the body portion 152 may have a shore A hardness in a range from about 16 to about 23. If the shore A hardness of the body portion 152 is less than about 16, the body portion 152 may be deformed more than necessary thereby not sufficiently supporting the printing portion 151. Therefore, an accuracy of the printing may decrease.

Each of the printing portion 151 and the body portion 152 may be formed of silicon. Further, oil may be added to each of the printing portion 151 and the body portion 152 in a process of forming the pad 150. In an embodiment, an amount of oil contained in the printing portion 151 may be greater than an amount of oil contained in the body portion 152. The greater an amount of oil added to silicon, the less hard, or softer the silicon. Accordingly, the hardness of the printing portion 151 may be less than the hardness of the body portion 152. Any type of suitable oil may be applied to the body portion 152 or the printing portion 151 or added to silicon within the spirit and scope of the disclosure.

In a sidewall 150S of the pad 150, at least a sidewall of a portion of the pad 150 where the printing portion 151 contacts the body portion 152 may be substantially perpendicular to the window 200. As an example, in the sidewall 150S of the pad 150, at least a sidewall of a portion of the pad 150 where the printing portion 151 contacts the body portion 152 may be substantially perpendicular to the plane area 210 of the window 200. A sidewall 151S of the printing portion 151 and a sidewall 152S of the body portion 152, which form the sidewall 150S of the pad 150, may extend along a direction substantially perpendicular to the window 200 and in substantially parallel with each other where the printing portion 151 contacts the body portion 152. Accordingly, when the pad 150 is pressed against the window 200, a pressure from the body portion 152 to the printing portion 151 may increase, and a deformation degree of the printing portion 151 may increase. In an embodiment, an entirety of the sidewall 151S of the printing portion 151 may be substantially perpendicular to the window 200.

In an embodiment, a lower surface 151L of the printing portion 151 may include an inclined area inclined with respect to the sidewall 151S of the printing portion 151. Because the inclined area is formed on the lower surface 151L of the printing portion 151, the lower surface 151L of the printing portion 151 may sequentially contact from a center portion toward a peripheral portion when the pad 150 is pressed against the window 200. Accordingly, bubbles or the like may not be generated between the window 200 and the pad 150 in the printing process, and print quality may be improved.

In an embodiment, the center portion of the lower surface 151L of the printing portion 151 may have a planarized shape as illustrated in FIG. 3. In other words, the center portion of the lower surface 151L of the printing portion 151 may have a straight cross-sectional shape. In another embodiment, the center portion of the lower surface 151L of the printing portion 151 may have a bent shape as illustrated in FIG. 4. In other words, the center portion of the lower surface 151L of the printing portion 151 may have a curved cross-sectional shape.

Figure 5:
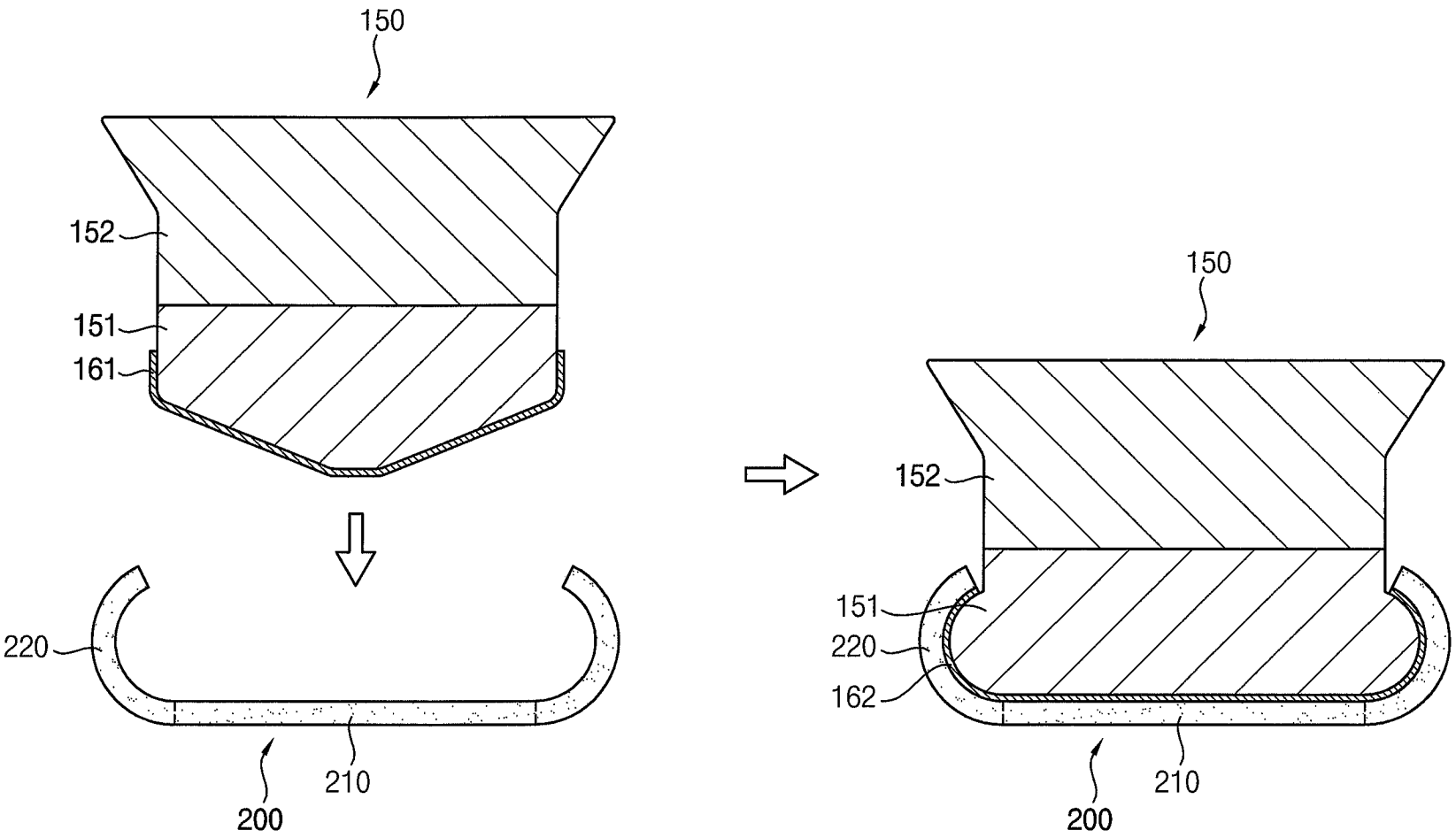
FIG. 5 is a diagram illustrating a process of printing a pattern on the window in FIG. 2 using the pad in FIG. 3.

FIG. 5 is a diagram illustrating a process of printing a pattern on the window 200 in FIG. 2 using the pad 150 in FIG. 3.

Referring to FIGS. 1, 2, 3, and 5, as the pad 150 to which ink 161 may be transferred may be lowered and pressed against the window 200, a pattern 162 may be printed on the window 200. When the pad 150 is pressed against the window 200, a pressure may be applied from the body portion 152 to the printing portion 151, and the printing portion 151 may be deformed such that a width of the printing portion 151 increases and a thickness of the printing portion 151 decreases. Therefore, the printing portion 151 may be in contact with an upper surface of the window 200 surrounded by the plane area 210 and the curved area 220. In an embodiment, when the pad 150 is pressed against the window 200, the printing portion 151 may be substantially pressed against the plane area 210 and the curved area 220 of the window 200. In other words, when the pad 150 is pressed against the window 200, an empty space may not exist between the printing portion 151 and the window 200. Accordingly, the ink 161 transferred to the printing portion 151 may be transferred to the plane area 210 and the curved area 220 of the window 200, so that the pattern 162 substantially identical to the pattern formed on the printing plate 120 may be printed on a substantially entire upper surface of the window 200.

In an embodiment, a thickness 151T of the printing portion 151 may be greater than the height 220H of the curved area 220 of the window 200. Accordingly, when the pad 150 is pressed against the window 200, the printing portion 151 may fill (for example, completely fill) a space surrounded by the plane area 210 and the curved area 220 of the window 200, and the pattern may be printed on the substantially entire upper surface of the window 200. In an embodiment as illustrated in FIG. 3 and FIG. 4, a thickness 151T of the printing portion 151 of the pad 150 may be defined as the height from a plane at which a surface of the sidewall 152S of the body portion 152 meets a surface of the sidewall 1515 of the printing portion 151 of the pad 150 to an apex or inverted apex of the printing portion 151 of the pad 150. The thickness 151T of the printing portion 151 may include the lower surface 151L of the printing portion 151.

In the pad printing device 100 according to the embodiments, the pad may include the printing portion 151 that has a relatively small hardness and the body portion 152 that has relatively large hardness, and at least the sidewall 150S of a portion of the pad 150 where the printing portion 151 contacts the body portion 152 may be substantially perpendicular to the plane area 210 of the window 200. In this case, when the pad 150 is pressed against the window 200 in which an angle of the curved area 220 is obtuse, the pad 150 may be deformed to completely fill a space surrounded by the plane area 210 and the curved area 220 of the window 200. Accordingly, the pad 150 may contact an entirety or a substantial entirety of the upper surface of the window 200, for example, an entirety of the upper surface of the curved area 220, so that the pattern 162 may be printed on the entire upper surface of the window 200.

The pad printing device according to the embodiments may be applied to a printing method for printing a pattern on a window for a display device included in a computer, a notebook, a mobile phone, a smartphone, a smart pad, a PMP, a PDA, an MP3 player, or the like. The windows for display devices to which the disclosure pertains is not exhaustive and may include other display devices within the spirit and scope of the disclosure. The display devices may include organic light emitting displays (OLEDs) and any other displays within the spirit and scope of the disclosure.

Although the pad printing device according to the embodiments has been described with reference to the drawings, the illustrated embodiments are examples, and may be modified and changed by those of ordinary skill in the art without departing from the spirit and scope of the disclosure as described in the following claims.

What is claimed is:

1. A pad printing device for printing a window of a display device, comprising:

a pad to transfer ink to the window, the pad comprising:

a printing portion to transfer the ink to the window by being pressed against the window; and a body portion disposed on the printing portion to apply a pressure to the printing portion, wherein a hardness of the printing portion is less than a hardness of the body portion, the printing portion has a shore A hardness from about 7 to about 15, the body portion has a shore A hardness from about 16 to about 23, and a sidewall of a portion of the pad where the printing portion contacts the body portion is substantially perpendicular to the window.

2. The pad printing device of claim 1, wherein the printing portion and the body portion include silicon, and an amount of an oil contained in the printing portion is greater than an amount of an oil contained in the body portion.

3. The pad printing device of claim 1, wherein a sidewall of the printing portion is substantially perpendicular to the window.

4. The pad printing device of claim 3, wherein a lower surface of the printing portion includes an inclined area inclined with respect to the sidewall of the printing portion.

5. The pad printing device of claim 4, wherein the inclined area is disposed on the lower surface of the printing portion, and the lower surface of the printing portion sequentially contacts from a center portion to a peripheral portion of the window when the pad is pressed against the window.

6. The pad printing device of claim 1, wherein the window includes a plane area and a curved area adjacent to an edge of the plane area, and an angle between a longitudinal cross-section of the plane area and a longitudinal cross-section of the curved area is an obtuse angle.

7. The pad printing device of claim 6, wherein a thickness of the printing portion of the pad is greater than a height of the curved area of the window.

8. The pad printing device of claim 7, wherein the thickness of the printing portion of the pad is the height from a plane at which a surface of the sidewall of the body portion meets a surface of the sidewall of the printing portion of the pad to an apex of the printing portion of the pad, and the thickness of the printing portion includes the lower surface of the printing portion.

9. The pad printing device of claim 6, wherein the angle between the longitudinal cross-section of the plane area and the longitudinal cross-section of the curved area is in a range from about 120 degrees to about 180 degrees.

10. The pad printing device of claim 6, wherein an upper portion of a sidewall of the printing portion is substantially perpendicular to a bottom portion of a sidewall of the body portion such that, when the pad is pressed against the window, the printing portion is substantially pressed against the plane area and the curved area of the window.

11. The pad printing device of claim 1, further comprising a pad supporter coupled to the pad to support the pad, wherein the body portion is disposed between the printing portion and the pad supporter.

12. A pad printing device for printing a window of a display device, comprising:

a pad to transfer ink to the window, the pad comprising:

a printing portion to transfer the ink to the window by being pressed against the window;

a body portion disposed on the printing portion to apply a pressure to the printing portion; and an upper portion of a sidewall of the printing portion where the printing portion contacts the body portion is substantially perpendicular to a bottom portion of a sidewall of the body portion so that, when the pad is pressed against the window, a deformation degree of the printing portion is greater than a deformation degree of the body portion such that a bottom portion of the sidewall of the printing portion is substantially pressed against a curved area of the window, wherein a hardness of the printing portion is less than a hardness of the body portion, the printing portion has a shore A hardness from about 7 to about 15, and the body portion has a shore A hardness from about 16 to about 23.

13. The pad printing device of claim 12, wherein the window includes:

a plane area; and a curved area adjacent to an edge of the plane area, wherein an angle between a longitudinal cross-section of the plane area and a longitudinal cross-section of the curved area is an obtuse angle.

14. The pad printing device of claim 13, wherein a thickness of the printing portion of the pad is greater than a height of the curved area of the window.

15. The pad printing device of claim 1, wherein the hardness, size, and shape of the printing portion are such that, when the printing portion is pressed against the window, the printing portion makes complete contact with a plane area and curved areas of the window, the plane area in a center of the window and each curved area at a distil edge of the window, and an angle between a longitudinal cross-section of the plane area and a longitudinal cross-section of the curved area is an obtuse angle.

* * * * *